United States Patent [19]

Hosogaya

[11] Patent Number: 4,491,046

[45] Date of Patent: Jan. 1, 1985

[54] PAPER CUTTING DEVICE FOR A PRINTER

[75] Inventor: Hiroshi Hosogaya, Shiojiri, Japan

[73] Assignee: Epson Corporation, Tokyo, Japan

[21] Appl. No.: 393,156

[22] Filed: Jun. 28, 1982

[30] Foreign Application Priority Data

Jun. 29, 1981 [JP] Japan ..... 56-101746

[51] Int. Cl.[3] ..... B26D 5/16

[52] U.S. Cl. ..... 83/589; 83/543; 83/582; 83/602; 83/609

[58] Field of Search ..... 83/543, 582, 584, 585, 83/589, 590, 600–609

[56] References Cited

U.S. PATENT DOCUMENTS 369,473 9/1887 Schmidt ..... 83/589 X 628,908 7/1899 Lewis ..... 83/589

1,005,879 10/1911 Ries ..... 83/611 X 1,098,510 6/1914 Krauth ..... 83/611 X

*Primary Examiner*—James M. Meister

*Attorney, Agent, or Firm*—Blum, Kaplan, Friedman, Silberman & Beran

[57] ABSTRACT

A paper cutting device for use in a printer for cutting off a sheet of recording paper. A first cutter blade is supported on a frame of the device and a second cutter blade pivotably supported on the frame is movable over the first cutter blade to cut off a section of the recording paper. A support member on the frame acts as a fulcrum for the second cutter blade. A drive lever pivots the second cutter blade about the support member towards the first cutter blade to cut off the recording paper. The device is constructed to prevent malfunction of and damage to the device and printer in which it is utilized.

8 Claims, 5 Drawing Figures

PAPER CUTTING DEVICE FOR A PRINTER

BACKGROUND OF THE INVENTION

This invention is directed to a paper cutting device for a printer and, in particular, to a cutting device for a printer for cutting off a section of recording paper which is constructed to prevent malfunction or damage to the device when an undue load is present. The device of the present invention prevents damage to the power source, drive mechanism, cutter blades and other components of the cutting device and also prevents malfunction thereof when an excessive load, such as a foreign object, is present.

Conventional devices for cutting off a sheet of recording paper have no satisfactory safety measures to protect against an undue or excessive load applied when foreign matter, such as when a piece of metal or other foreign object gets caught between the cutter blades of the cutting device, or when the cutter blades are stuck or locked. In a cutting device which includes a movable cutter blade and a fixed cutter blade, when the movable cutter blade or fixed cutter blade is damaged or the movable cutter blade is caused to malfunction, the paper feeding device in the printer tends to undergo problems such as paper jams, with the result that a printing machine which includes a paper cutting device will be subjected to malfunctioning. Accordingly, a paper cutting device for a printer which is constructed to insure proper operation thereof and which prevents damage to the device and malfunction thereof when an undue load is present, is desired.

SUMMARY OF THE INVENTION

Generally, speaking, in accordance with the instant invention, a paper cutting device for use in a printer for cutting off a piece of recording paper is provided. The device includes a frame and a first cutter blade supported on the frame. A second cutter blade is pivotably supported on the frame and is movable over the first cutter blade to cut off a piece of the recording paper which extends between the first and second cutter blades. The second cutter blade, when in a ready position, is spaced from the first cutter blade to permit the recording paper to extend therebetween. The frame includes a support member which acts as a fulcrum about which the second cutter blade is pivotable. A spring biases the second cutter blade against the support member. A drive member pivots the second cutter blade from its ready position about the support member and towards the first cutter blade in order to cut off the recording paper.

In a preferred embodiment, the drive member is adapted to forcibly return the second cutter blade to its ready position when an undue load or the presence of foreign matter acts to prevent normal return. A drive mechanism which drives the drive member insures proper operation of the device and acts to prevent malfunction and damage to the components of the device and the printer in which the device is utilized.

Accordingly, it is an object of the instant invention to provide an improved paper cutting device for a printer.

Another object of the instant invention is to provide a paper cutting device for a printer which is constructed to prevent damage to the cutter blades and drive mechanism when an undue load or foreign matter is present.

A further object of the instant invention is to provide a paper cutting device for a printer which is constructed to prevent malfunctioning of the cutter blade members and drive mechanism for protection against problems with paper feeding such as paper jam and the like.

Still another object of the instant invention is to provide an inexpensive and safe device for cutting off a sheet of recording paper in a printer.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENTS

Figure 1:
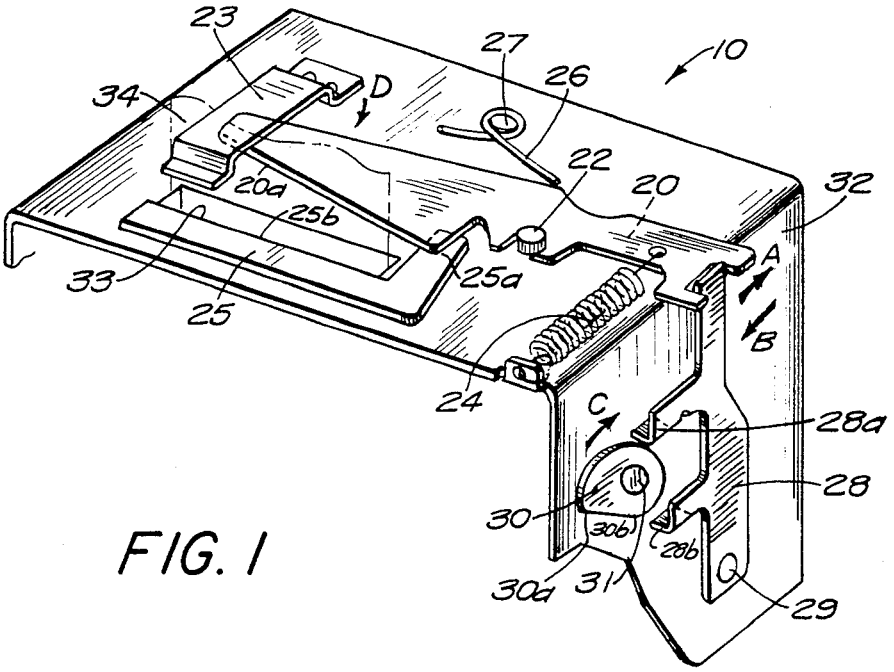
FIG. 1 is a perspective view of a paper cutting device for a printer constructed in accordance with the present invention, with the device shown in a ready position.

Reference is made to FIGS. 1 through 5, wherein a paper cutting device, generally indicated at 10, constructed in accordance with the present invention for use in a printer is depicted. Paper cutting device 10 includes a movable cutter blade 20, a cutter or support shaft 22 about which the cutter blade 20 is angularly or pivotably movable, a presser or leaf spring 23 for preventing cutter blade 20 from moving upwardly, a return spring 24 for returning cutter blade 20 to its ready position after it has been actuated and the paper cut, and a fixed cutter blade 25 across which cutter blade 20 is movable. A release or coil spring 26 has one end secured to a frame 32 for pressing the cutter blade 20 against the cutter shaft 22. Release spring 26 is supported on a release spring pin 27. Cutter blade 20 is actuated by a cutter drive lever 28 which is pivotally coupled to an attachment shaft 29. A rotatable drive cam 30 which is fixed to a drive cam shaft 31 which is rotated by the power driver of the printer in which device 10 is used. Frame 32 has a slot 33 for passage therethrough of a sheet of recording paper, shown in phantom as 34.

Figure 2:
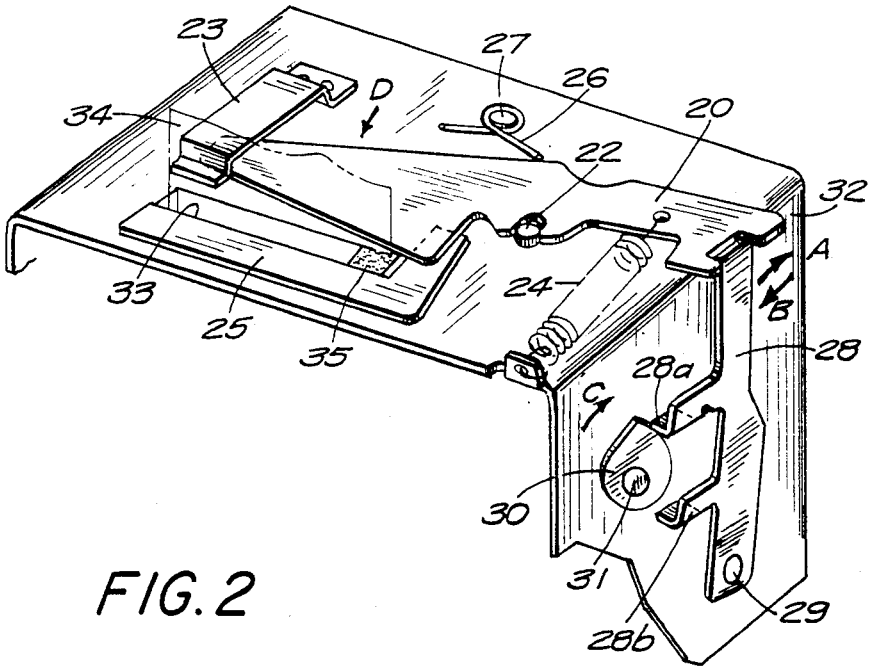
FIG. 2 is a perspective view of the paper cutting device depicted in FIG. 1, with a foreign object shown placing an undue load on the device.

The manner in which device 10 operates will now be described. When power is transmitted from the printer drive source to drive cam shaft 31, drive cam 30 which is fixed to the drive cam shaft 31 starts rotating. Drive cam shaft 31 is intermittently driven, such as by a spring-operated clutch controlled by an external signal for timed operation, to cause drive cam 30 to make one revolution. As drive cam 10 rotates clockwise in the direction of arrow C, it moves into engagement with a cam follower portion 28*a* of cutter drive lever 28 which is rotatably supported on attachment shaft 29 (FIG. 2). Cutter drive lever 28 is angularly moved in the direction of arrow A, causing cutter blade 20 pivotably supported on cutter shaft 22 to angularly move counterclockwise in the direction of arrow D. Cutter blade 20 now moves across the fixed cutter blade 25 to cut off the sheet of recording paper 34.

When in a ready position (FIG. 1), cutter blade 20 is disposed across a portion 25*a* of fixed cutter blade 25 and is pressed thereagainst by leaf spring 23. Actuation of drive cam 30 and cutter drive lever 28 enables cutter blade 20 to move across a cutting edge 25*b* of the fixed cutter blade 25 while in contact therewith, thus severing the sheet of recording paper 34. At this time, the release spring 26 presses (biases) cutter blade 20 against cutter shaft 22 with a force which is large enough to overcome the normal load imposed on cutter blade 20 when cutter blade 20 cuts off the sheet of recording paper 34.

The presser spring 23 presses cutter blade 20 downwardly to maintain the movable and fixed cutter blades 20 and 25 in mutual contact against the cutting load imposed by the sheet of recording paper 34 while cutter blade 20 is moving across the fixed cutter blade 25. When the severance of the sheet of recording paper 34 has been completed, that is, when the operation of the cutter blade 20 is over in a normal condition through operation of cutter drive lever 28 actuated by drive cam 30, cutter blade 20 is caused to return to its ready position under the resiliency of return spring 24 acting between the cutter blade 20 and frame 32.

Figure 5:
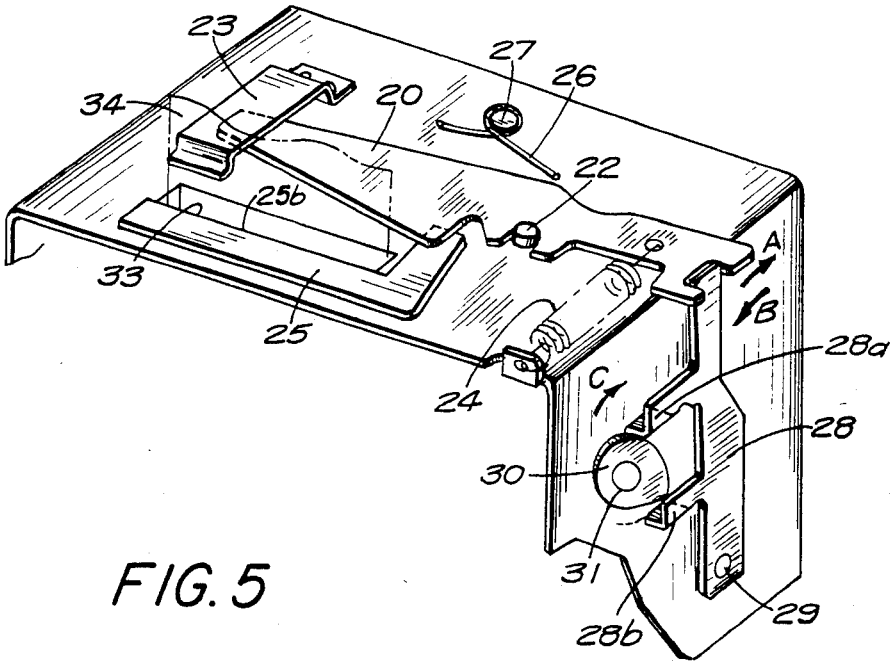
FIG. 5 is a perspective view of the paper cutting device depicted in FIG. 1, showing the manner in which the cutter blade and cutter drive lever are returned to their ready position under a normal condition.

As described above, in a normal cutting condition, transmission of power from the printer drive mechanism via a one-revolution clutch or the like to drive cam shaft 31 causes drive cam 30 to rotate, whereupon cutter drive lever 28 is angularly moved about attachment shaft 29 in the direction of arrow A by contacting engagement with a large-diameter cam surface 30*a* of drive cam 30. Cutter blade 20 is now brought into traversing engagement with fixed cutter blade 25 to sever the sheet of recording paper 34. When the cutting of the paper is completed, the cam-follower portion 28*a* of drive lever 28 engages with a smaller-diameter cam surface 30*b* of drive cam 30 past the maximum-diameter portion 30*a* thereof, whereupon return spring 24 causes the cutter blade 20 to angularly move cutter drive lever 28 rapidly in the direction of arrow B. Upon engagement of camfollower portion 28*a* of cutter drive lever 28 with a smaller-diameter portion 30*b* of the drive cam 30, drive lever 28 and the cutter blade 20 are in their ready position (FIG. 5).

The drive system will be protected when foreign matter 35, such as a metal piece, enters between cutter blade 20 and fixed cutter blade 25 or when the cutter blade 20 and fixed cutter blade 25 are stuck or locked against their mutual traversing movement. More specifically, operation of the drive system upon entrance of foreign matter between the cutter blade 20 and fixed cutter blade 25 will be described with reference to FIG. 2.

Actuation of the drive system for driving the component parts to cut off the sheet of recording paper 34 is the same as that for severing the sheet of recording paper 34 in a normal condition as described above. When cutter blade 20 hits foreign matter 35 as the cutter blade 20 moves across fixed cutter blade 25 after the cutter blade 20 has started being actuated, cutter blade 20 and fixed cutter blade 25 become stuck or locked and are unable to cut off the sheet of recording paper 34. Then, cutter blade 20 is angularly displaced in the direction of arrow A out of engagement with shaft 22 about the foreign matter 15 which then serves as a fulcrum against the pressing force exerted by release spring 26. Cutter drive lever 28 is now rendered possible to angularly move about attachment shaft 29 and to operate by engagement with the cam surface of drive cam 30, as in the normal process for cutting the sheet of recording paper 34 described above. Accordingly, the operative members of device 10 including cutter blade 20 and fixed cutter blade 25 are prevented from undergoing an undue load or stress and hence from being broken or otherwise damaged.

A safety device for forcibly returning cutter blade 20 to its ready position when cutter blade 20 fails to operate properly under an undue load to return to its ready position under the resiliency of return spring 24 will be described with reference to FIG. 3 and FIG. 4. Cutter drive lever 28 is angularly moved in the direction of arrow A in the same operation as that for severing the sheet of recording paper 34 described above.

When cutter blade 20 fails to move across fixed cutter bade 25 and hence fails to cut off the sheet of recording paper 34, cutter drive lever 28 completes its operation, and yet cutter blade 20 fails to return to its ready position under the bias of return spring 24. In such a situation, cutter blade 20 is forcibly returned to its ready position by bringing the cam surface 30*a* of the drive cam 30 into engagement with a second cam follow portion 28*b* of cutter drive lever 28.

Figure 3:
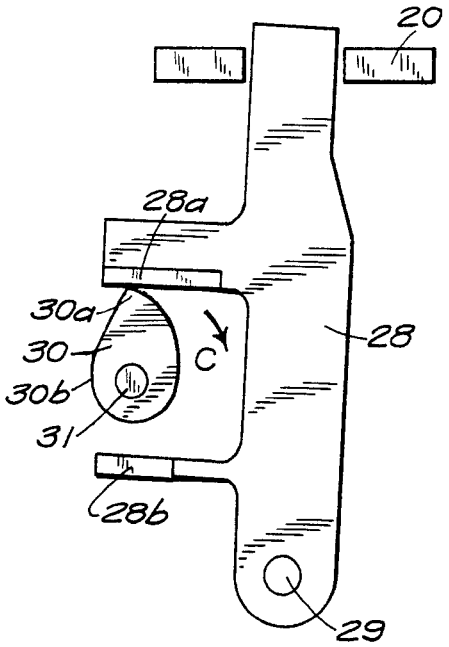
FIG. 3 is an elevational view of the cutter drive lever and drive cam depicted in FIG. 1 as they are engaged when a sheet of recording paper is cut off.
Figure 4:
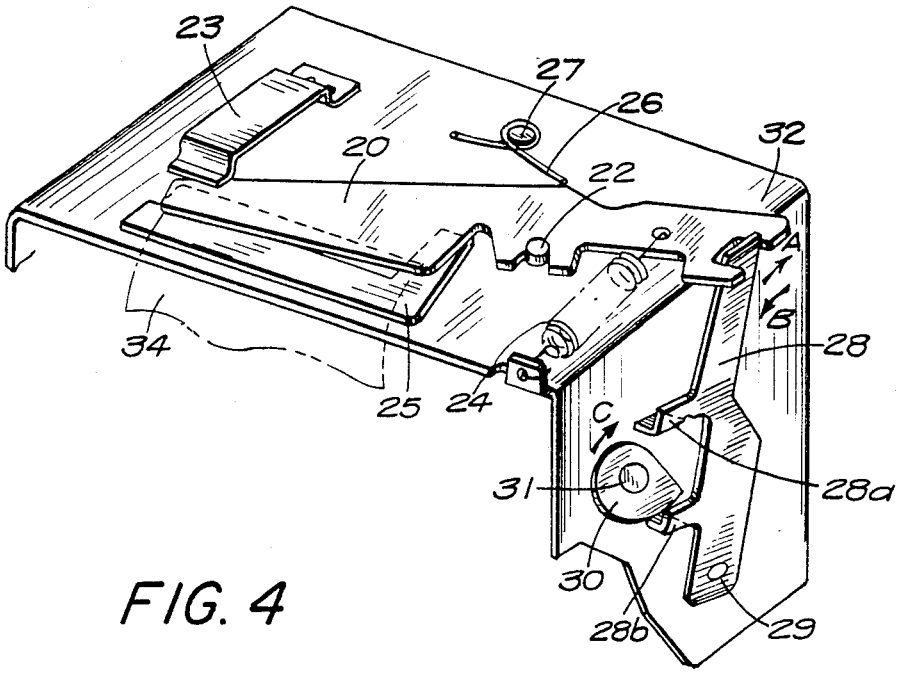
FIG. 4 is a perspective view of the paper cutting device depicted in FIG. 1, showing the manner in which the cutter blade and cutter drive lever are forceably released from a locked condition.

The maximum-diameter portion 30*a* of drive cam 30 is held against the cam follower portion 28*a* of cutter drive lever 28 at the time of severing the sheet of recording paper 34 under normal conditions, as illustrated in FIG. 3. During a normal mode of returning operation, drive cam 30 rotates in the direction of arrow C simultaneously with completion of the severance of the recording paper 34 until the cam follower portion 28*a* of cutter drive lever 28 is caused under the resiliency of return spring 24 to engage the minimum-diameter portion 30*b* of drive cam 30, whereupon the cutter blade 20 and cutter drive lever 28 return to the ready position under the force of return spring 24. Under a larger load, cutter drive lever 28 and cutter blade 20 fail to return under the spring force of return spring 24, and the cam follower portion 28*a* of drive lever 28 does not engage the minimum-diameter portion 30*b* of drive cam 30 upon the rotation of drive cam 30 in the direction of arrow C.

Under this condition, when drive cam 30 further rotates in the direction of arrow C, the maximum-diameter portion 30*a* of drive cam 30 is brought into engagement with the second cam follower 28*b* of cutter drive lever 28, forcing cutter drive lever 28 to rotate in the direction of arrow B. Thus, cutter blade 20 is forced to return back to its ready position.

As shown in FIG. 5, cutter blade 20 and cutter drive lever 28 can be returned only under the biasing force of return spring 24 after the sheet of recording paper 34 has normally been cut off. Under such a normal cutting operation, drive lever 28 is returned to the ready position before the maximum-diameter portion 30*a* of drive cam 30 engages the second cam follower portion 28*b* of cutter drive lever 28. Thus, cutter blade 20 can be returned after the normal cutting operation without imposing an undue load on drive cam 30 and the drive members of the printer.

While in the illustrated embodiment cutter blade 20 has a continuous cutting edge 20*a* along the portion movable across fixed cutter blade 25, cutter blade 20 or fixed cutter blade 25 may partly be sloted or grooved to allow the sheet of recording paper to remain partially uncut. This arrangement provides the ease with which receipts can be handled on cash registers and the like. The device for cutting off a sheet of recording paper of the present invention is less costly and safer in that it has a reduced number of cutter blade parts and is simple in shape and design.

According to the present invention, as described above, a device for cutting off a sheet of recording paper has movable and fixed cutter blades movable into mutual contact by drive power from a motor or the like to sever the sheet of recording paper. The device includes a safety device for protecting a drive mechanism when an undue load is imposed during severance of the sheet of recording paper, and a forced return device for insuring reliable operation of the movable cutter blade.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A paper cutting device for use in a printer for cutting off a piece of recording paper comprising a frame, a first cutter means supported on said frame, a second cutter means pivotably supported on said frame and spaced from said first cutter means when in a ready position to permit said recording paper to extend therebetween, said frame including a support member about which said second cutter means is pivotable, bias means for biasing said second cutter means against said support member and drive means for pivoting said second cutter means about said support member and towards said first cutter means whereby said recording paper is cut, said drive means including a drive lever coupled to said second cutter means, said drive lever moving said second cutter means between its first ready position where said second cutter means is spaced from said first cutter means and a second position where said second cutter means is moved over said first cutter means for cutting off said recording paper, said frame including a cam surface means rotatably supported thereon, said drive lever including first cam follower means engaging said cam surface means, said drive means acting to rotate said cam surface means against said first cam follower means so that said drive lever can move said second cutter means from its first position towards its second position, spring means coupled intermediate said frame and said second cutter means for returning said second cutter means to its first position, said drive lever including a second cam follower means, said second cam follower means engaging said cam surface means to forcibly return said second cutter means to its first position when the force of said spring means fails to return said second cutter means to its first position.

2. The paper cutting device as claimed in claim 1, wherein said frame includes a leaf spring means for urging said second cutter means against said first cutter means.

3. The paper cutting device as claimed in claim 1, wherein said drive lever includes first and second ends, the first end of said drive lever being pivotally supported on said frame and the second end of said drive lever being coupled to said second cutter means.

4. A paper cutting device for use in a printer for cutting off a piece of recording paper comprising a frame, a fixed cutter blade mounted on said frame, a movable cutter blade supported on said frame and movable across said fixed cutter blade from a ready position to cut off a piece of said recording paper which extends between said fixed and movable cutter blades, support means on said frame for supporting said movable cutter blade for angular movement, a drive lever coupled to said movable cutter blade for driving said movable cutter blade, return spring means coupled intermediate said frame and said movable cutter blade for returning said movable cutter blade and said drive lever to said ready position, and drive means for driving said drive lever, said drive lever and movable cutter blade being forcibly returned to said ready position by said drive means when said return spring fails to return said movable cutter blade and said drive lever to said ready position.

5. The paper cutting device as claimed in claim 4, wherein said drive means includes a camming surface and means for rotating said camming surface, said drive lever including a first cam follower engaging said camming surface.

6. The paper cutting device as claimed in claims 4 or 5, further comprising bias means for biasing said movable cutter blade against said support means.

7. The paper cutting device as claimed in claim 6, wherein said drive lever moves said second cutter blade out of engagement with said support means when an undue load is placed on said movable cutter blade.

8. The paper cutting device as claimed in claim 5, wherein said drive lever includes a second cam follower, said second cam follower engaging said camming surface to forcibly return said movable cutter blade to its ready position when said return spring fails to return said movable cutter blade to its ready position.

* * * * *